US008966873B2

(12) United States Patent
Kübler

(10) Patent No.: US 8,966,873 B2
(45) Date of Patent: Mar. 3, 2015

(54) YARN-PRODUCING APPARATUS FOR AN AIR SPINNING MACHINE WITH AN INSET AND A SPINNERET EQUIPPED THEREWITH

(71) Applicant: Maschinenfabrik Rieter AG, Winterthur (CH)

(72) Inventor: Markus Kübler, Geislingen (DE)

(73) Assignee: Maschinenfabrik Rieter AG, Winterthur (CH)

( * ) Notice: Subject to any disclaimer, the term of this patent is extended or adjusted under 35 U.S.C. 154(b) by 0 days.

(21) Appl. No.: 14/065,645

(22) Filed: Oct. 29, 2013

(65) Prior Publication Data

US 2014/0116022 A1 May 1, 2014

(51) Int. Cl.
*D01H 4/02* (2006.01)
*D01H 1/115* (2006.01)

(52) U.S. Cl.
CPC . *D01H 4/02* (2013.01); *D01H 1/115* (2013.01)
USPC ..... 57/350

(58) Field of Classification Search
CPC ..... D01H 1/115; D01H 4/02
USPC ..... 57/333, 350
See application file for complete search history.

(56) References Cited

U.S. PATENT DOCUMENTS

| | | | | |
|---|---|---|---|---|
| 4,945,718 | A * | 8/1990 | Stahlecker et al. | 57/333 |
| 6,029,435 | A | 2/2000 | Okamoto | |
| 6,314,714 | B1 * | 11/2001 | Feuerlohn et al. | 57/343 |
| 6,438,934 | B1 * | 8/2002 | Foster et al. | 57/328 |
| 7,681,390 | B2 * | 3/2010 | Wust et al. | 57/350 |
| 2003/0101710 | A1 * | 6/2003 | Wust et al. | 57/328 |
| 2008/0072562 | A1 * | 3/2008 | Wust et al. | 57/333 |
| 2012/0192541 | A1 | 8/2012 | Artzt et al. | |

FOREIGN PATENT DOCUMENTS

| | | |
|---|---|---|
| DE | 103 33 411 A1 | 2/2005 |
| DE | 601 02 649 T2 | 4/2005 |

OTHER PUBLICATIONS

German Search Report, Jul. 2, 2013.

* cited by examiner

*Primary Examiner* — Shaun R Hurley
(74) *Attorney, Agent, or Firm* — Dority & Manning, P.A.

(57) ABSTRACT

A yarn-producing apparatus for an air spinning machine, which is used for producing a yarn from a fiber strand with the assistance of an air flow, has a spinning tip with an inlet opening surrounded by the outer surface of the spinning tip, in the area of which a yarn is able to be produced with the assistance of the air flow. The yarn-producing apparatus has an internal inset with a draw-off conduit adjacent to the inlet opening for the yarn and several air outlets branching off on the side from the draw-off conduit, such that an air flow introduced counter to the direction of spinning (S) in the draw-off conduit can escape in part through the air outlets and in part through the inlet opening. In addition, a spinning unit with a corresponding yarn-producing apparatus is provided.

15 Claims, 6 Drawing Sheets

YARN-PRODUCING APPARATUS FOR AN AIR SPINNING MACHINE WITH AN INSET AND A SPINNERET EQUIPPED THEREWITH

FIELD OF THE INVENTION

This invention relates to a yarn-producing apparatus for an air spinning machine, which is used for producing a yarn made from a fiber strand with the assistance of an air flow. The yarn-producing apparatus has a spinning tip with an inlet opening surrounded by the outer surface of the spinning tip, in the area of which a yarn is able to be produced with the assistance of the air flow. Moreover, a spinneret of an air spinning machine is suggested, which is used for producing a yarn made from a fiber strand with the assistance of an air flow. The spinneret features a swirl chamber surrounded in part by a swirl chamber wall, with an inflow outlet for a fiber strand and a yarn-producing apparatus extending at least in part into the swirl chamber. Air nozzles are associated to the swirl chamber and are aligned in the direction of the outer surface of the yarn-producing apparatus, and through which the air is able to be conducted into the swirl chamber in order to impart a twist onto the fiber strand in the area of an inlet opening of the yarn-producing apparatus. The yarn-producing apparatus features a draw-off conduit adjacent to the inlet opening, through which the yarn is extractable from the swirl chamber in the spinning direction. Finally, an inset for a yarn-producing apparatus of a corresponding air spinning machine is described, which inset is used for producing a yarn made from a fiber strand with the assistance of an air flow, whereas the yarn-producing apparatus has a spinning tip with an inlet opening surrounded by the outer surface of the spinning tip, in the area of which a yarn is able to be produced with the assistance of the air flow.

BACKGROUND

A generic yarn-producing apparatus is known from, for example, DE 10 2009 034 206 A1. The yarn-producing apparatus has an exhaust air outlet connected to a draw-off conduit for the yarn for the partial extraction of air, which is introduced into the draw-off conduit for the yarn during a piecing process (for which the yarn end is to be guided, with the assistance of the air, counter to the actual spinning direction through the draw-off conduit). The partial extraction of the air ensures that only a partial air flow, which is introduced into the draw-off conduit during the piecing, has to escape through the inlet opening of the yarn producing apparatus. In other words, the air flow (which is introduced into the draw-off conduit, for example, with the assistance of an injection nozzle leading to the draw-off conduit) is segregated into two partial air flows in the area of the inlet opening, whereas a first partial air flow leaves the draw-off conduit through the exhaust air outlet in the area of the inlet opening, while the second partial air flow enters the swirl chamber surrounding the yarn-producing apparatus through the inlet opening, and thereby brings about the return of the end of the yarn desired during the piecing process.

The reason for the segregation of the supplied air is the fact that the area of the inlet opening features an inner diameter that is smaller than the draw-off conduit following in the spinning direction. Through the branching off to the side of the first partial air flow in the area of the inlet opening, a backing up of air in the transition area between the draw-off conduit and the inlet opening is ultimately avoided, and a uniformly high air speed is ensured.

With the assistance of the air flow, the end of the yarn is moved forward into the swirl chamber and ultimately through an inflow outlet of the swirl chamber into the area in front of the spinneret with the swirl chamber. There, it is brought into contact with a fiber strand and is led, together with this, back into the swirl chamber, in which the actual spinning process can finally be continued.

What is disadvantageous with the described solution is that the air flow coming out through the exhaust air outlet inevitably likewise arrives in the swirl chamber, and an air flow unfavorable for the return of the end of the yarn can be produced there.

SUMMARY

Therefore, an object of this invention is to provide a yarn-producing apparatus and a spinneret equipped with it, which takes account of the disadvantage noted above. Additional objects and advantages of the invention will be set forth in part in the following description, or may be obvious from the description, or may be learned through practice of the invention.

The task is solved by a yarn-producing apparatus along with a spinneret, with the features of the appended claims.

In accordance with the invention, the yarn-producing apparatus is characterized in that it has an internal inset with a draw-off conduit following the inlet opening for the yarn, and several air outlets branching off on the side from the draw-off conduit. In other words, the air outlets are located in an area that is at least partially surrounded by a wall of the spinning tip.

Thus, an air flow introduced into the draw-off conduit counter to the spinning direction is—as in the state of the art described above—likewise segregated during a piecing process, such that the air introduced during a piecing process (for example, with the assistance of an injection nozzle) can escape in part through the air outlets and in part through the inlet opening. However, in contrast to the known solutions, through the placement of the inset and hence also the air outlets, it can be ruled out that the air escaping through air outlets arrives in the swirl chamber (in which a swirling air flow is produced during the spinning operation and with the assistance of which the actual production of yarn takes place). Rather, only the part of air flow that leaves the draw-off conduit through the inlet opening of the yarn-producing apparatus leaks into the swirl chamber, whereas this is desired and necessary for the return of an end of the yarn into the swirl chamber.

In order to ensure the advantageous screening of the air outlets, the spinning tip may feature a (for example, cylindrical) wall section, which is typically connected to a cone-shaped tip area, in which the inlet opening is located. The wall section advantageously surrounds the inset under the invention (at least in part) and thus represents a spatial barrier for the air coming out of the air outlets. Advantageously, the yarn-producing apparatus is finally installed in a spinneret of an air spinning machine in such a way that the wall section, possibly together with another wall section of the spinneret, defines a chamber, which surrounds the inset. If the chamber is ultimately in contact with a corresponding air extraction conduit, the air escaping through the air outlets may be extracted from the spinneret through the chamber and ultimately through the air extraction conduit, without the air having to pass and/or being able to pass the swirl chamber.

As a result, the yarn-producing apparatus under the invention facilitates a particularly reliable return of an end of the yarn during a piecing process, as the air flow causing the return (which extends from an injection nozzle through the draw-off conduit and the inlet mouth in the swirl chamber) does not affect the air flow that leaves the draw-off conduit through the air outlets.

It is advantageous if the inset includes several panels adjacent to each other, each with an opening, which collectively confine a part of the draw-off conduit. In other words, the part of the draw-off conduit that runs within the inset consists of the individual openings of the respective panels, whereas it is to be pointed out in this connection that the draw-off conduit must not feature a continuous conduit wall. Rather, the panels should be spaced from each other with the assistance of spacers. The spacers are in turn to be placed in such a manner that the air outlets under the invention are formed by the open spaces existing between the panels. For this purpose, the panels may be present as disk-shaped bodies, which feature an opening (preferably in the center) and are kept at a distance from the corresponding adjacent panels with the assistance of spacers, whereas the spacers have dimensions that allow for the escape of air between the two adjacent panels.

It is likewise advantageous if the openings are formed by holes introduced in the middle of the panels and arranged concentrically among each other. The holes are able to be produced easily and precisely, and ultimately form a circular partial area of the draw-off conduit, which preferentially flows counter to the spinning direction into the inlet opening, and after installation in a spinneret, in the spinning direction into a conduit section of the spinneret housing.

Moreover, it is advantageous if the diameters of at least a majority of the holes are reduced in the direction facing the spinning tip. This gives rise to gradations, through which the respective outer area of an air flow flowing counter to the spinning direction through the draw-off conduit is, to an extent, "stripped off" from the inner air flow, and extracted through the corresponding air outlets. As a result, the speed of the middle air flow remains constant, as the reduced diameter in conjunction with the air outlet brings about a reduction of the flow rate, but not a slowing down of the central air flow. In this manner, it is ultimately ensured that the air speed inside an air flow introduced into the draw-off conduit, over the entire length of the draw-off conduit, has a speed that is high enough to guide a yarn end counter to the spinning direction through the draw-off conduit and ultimately also the inlet opening of the spinning tip.

It is also advantageous if at least a majority of the panels feature a height running in the longitudinal direction of the draw-off conduit, which measures between 0.5 mm and 3.0 mm, preferably between 1.0 mm and 2.0 mm. For example, provision of the inset with a tip and an end section turned away from the tip, the height of which differs from the height of the individual panels lying in between, is conceivable. Moreover, the panels may feature a different height, whereas the values above have been proven. The number of panels is preferably between 3 and 10, preferably between 5 and 7.

It is particularly advantageous if the mutual spacing, effected by the spacers, of at least a majority of the panels measures between 0.2 mm and 2.0 mm, preferably between 0.4 and 1.5 mm. Generally, it is conceivable that the spacing between each panel is the same. An increasing or decreasing spacing in the spinning direction is likewise possible. In addition, it is preferable that the inset has a tip facing the inlet opening, the longitudinal extension of which running parallel to the longitudinal axis of the draw-off conduit is greater than the height of the panel stated above. The same also applies, preferably, to an end section of the inset turned away from the tip.

It is likewise advantageous if at least a majority of the spacers is formed as a crosspiece connecting two adjacent panels with each other, whereas each of the crosspieces is placed in the edge area of the panels, preferably spaced from the openings. The crosspieces can be formed as one piece with the panels. It is also conceivable that the crosspieces are glued between each of the two adjacent panels or between one panel and the tip of the inset, and/or between one panel and the end section of the inset stated above. In addition, it is preferable that more than one crosspiece is arranged between the particular panels, in order to increase the stability of the inset.

Moreover, it is extremely advantageous if the inset has a tip facing the inlet opening, which is connected, preferably glued and/or pressed, to an inner surface section of the spinning tip. The tip of the inset thus preferably follows the inner surface structure of the spinning tip, and thereby passes directly into the inlet mouth of the yarn-producing apparatus or its spinning tip. For this purpose, the tip of the inset preferably has a conical-shaped or truncated conical-shaped outer contour, with which it adjoins the correspondingly shaped inner contour of the inset.

It is likewise advantageous if, in its front side turned away from the inlet opening, the inset features a change in cross-section that is preferably external, through which it is connectable with an outlet area of a spinneret of the air spinning machine. Thereby, the change in cross-section may be present as, for example, a ring-shaped cross-section tapering or extension, which, after installation into a spinneret, is able to be brought into connection with a corresponding counter-section of the spinneret in a positive-locking manner. If the specified counter-section also features a corresponding conduit section, which connects to the draw-off conduit of the inset and forms with this a uniform draw off conduit of the spinneret, the change in cross-section may bring about a particularly airtight connection of the inset and the counter-section, such that, during the spinning or piecing process, the loss of pressure through air leakage can be avoided.

It is particularly advantageous if the inset is formed as one piece and preferably as a die-cast part, which is preferably provided with a surface coating, which features a greater resistance to wear than the die-cast part. For example, the inset may be made of plastic, which is then finished by a corresponding coating.

The spinneret for an air spinning machine, which is used for producing a yarn from a fiber strand with the assistance of an air flow, is ultimately characterized in that the yarn-producing apparatus protruding into the swirl chamber of the spinneret has an inner inset in accordance with the preceding description, such that an air flow introduced into the draw-off conduit during a piecing process counter to the spinning direction can escape in part through the air outlets and in part through the inlet opening.

In this connection, it is particularly advantageous if the draw-off conduit is in contact with at least one injection nozzle, through which an air flow directed counter to the spinning direction is able to be introduced into the draw-off conduit. Through this, during a piecing process, by which an end of the yarn must be transported counter to the spinning direction through the draw-off conduit up to the area in front of the spinneret, an air flow is able to be produced, which extends through the draw-off conduit in the specified direction. If the inset also features the specified air outlets and preferably also the described panels, the air flow within the inset will be segregated into a first and a second air flow, whereas the first air flow can leave the inset through the inlet opening of the spinning tip, and the second air flow can escape through the air outlets.

It is also advantageous if the spinning tip of the yarn-producing apparatus merges into a wall that is preferably sleeve-shaped, which surrounds the inset and, together with the spinning tip, confines an inner chamber of the yarn producing apparatus that incorporates the inset. In addition, the chamber should also lead to at least one air extraction conduit, such that the proportion of the air brought in through an injection nozzle, which is separated through the outlet openings of the inset, can leave the spinneret exclusively through the chamber and the air extraction conduits adjacent to it.

In other words, with the assistance of the inset, a segregation of an air flow introduced through at least one injection nozzle takes place in such a manner that a first partial air flow is forcibly guided into the swirl chamber through the inlet opening of the spinning tip, and a second air flow is forcibly guided into the chamber through the air outlets of the inset, and from there into at least one air extraction conduit, without this arriving in the swirl chamber. Therefore, the mixing of the two air flows within the swirl chamber can be ruled out, such that a yarn can be reliably guided counter to the spinning direction through the spinneret, as soon as the injection nozzle(s) is or will be supplied with compressed air.

The air extraction conduit(s) either are connected with an air extraction system arranged outside the spinning unit, or end in an outlet that is placed in the area of the outer surface of the spinneret, such that the escaping air can be segregated into the space surrounding the spinneret. If necessary, the outlet or the air extraction conduit(s) can be fitted with a controllable valve, in order to close the specified conduits during the spinning operation and through this be able to avoid air leakage.

It is likewise advantageous if the spinning tip, preferably in the area of its front side turned away from the inlet opening, is set against the wall, whereas the transition between the wall and spinning tip is preferably constructed in an airtight manner, in order to avoid air flow leakage. For this purpose, the spinning tip may feature a retaining section that is particularly ring-shaped, which is in operative connection with a cap sleeve in a positive-locking manner. The cap sleeve is in turn connected to the above wall and presses the spinning tip in the direction of the same, such that a stable connection of the spinning tip to the section of the spinneret featuring the wall is ensured.

It is advantageous here if the cap sleeve is bolted to the wall. For this purpose, the wall and the cap nut preferably have corresponding threads, such that the force with which the spinning tip is pressed against the adjacent wall of the spinneret and/or a washer that lies in between can be easily adjusted. In addition, a removal or exchange of the spinning tip and/or the inset is possible at any time.

The inset of a yarn-producing apparatus of an air spinning machine under the invention, which is used for producing a yarn from a fiber strand with the assistance of an air flow, whereas the yarn-producing apparatus has a spinning tip with an inlet opening surrounded by the outer surface of the spinning tip, in the area of which a yarn is able to be produced with the assistance of the air flow, is finally characterized in that it has a draw-off conduit for the yarn and several air outlets branching off on the side from the draw-off conduit, such that an air flow introduced counter to the spinning direction in the draw-off conduit can escape in part through the air outlets and in part through the inlet opening.

Regarding possible additional forms of the inset, reference is made to the preceding and following description, whereas all features concerning the inset may be realized individually or in any combination.

BRIEF DESCRIPTION OF THE DRAWINGS

Other advantages of the invention are described in the following embodiments. The following are shown.

DETAILED DESCRIPTION

Figure 1:
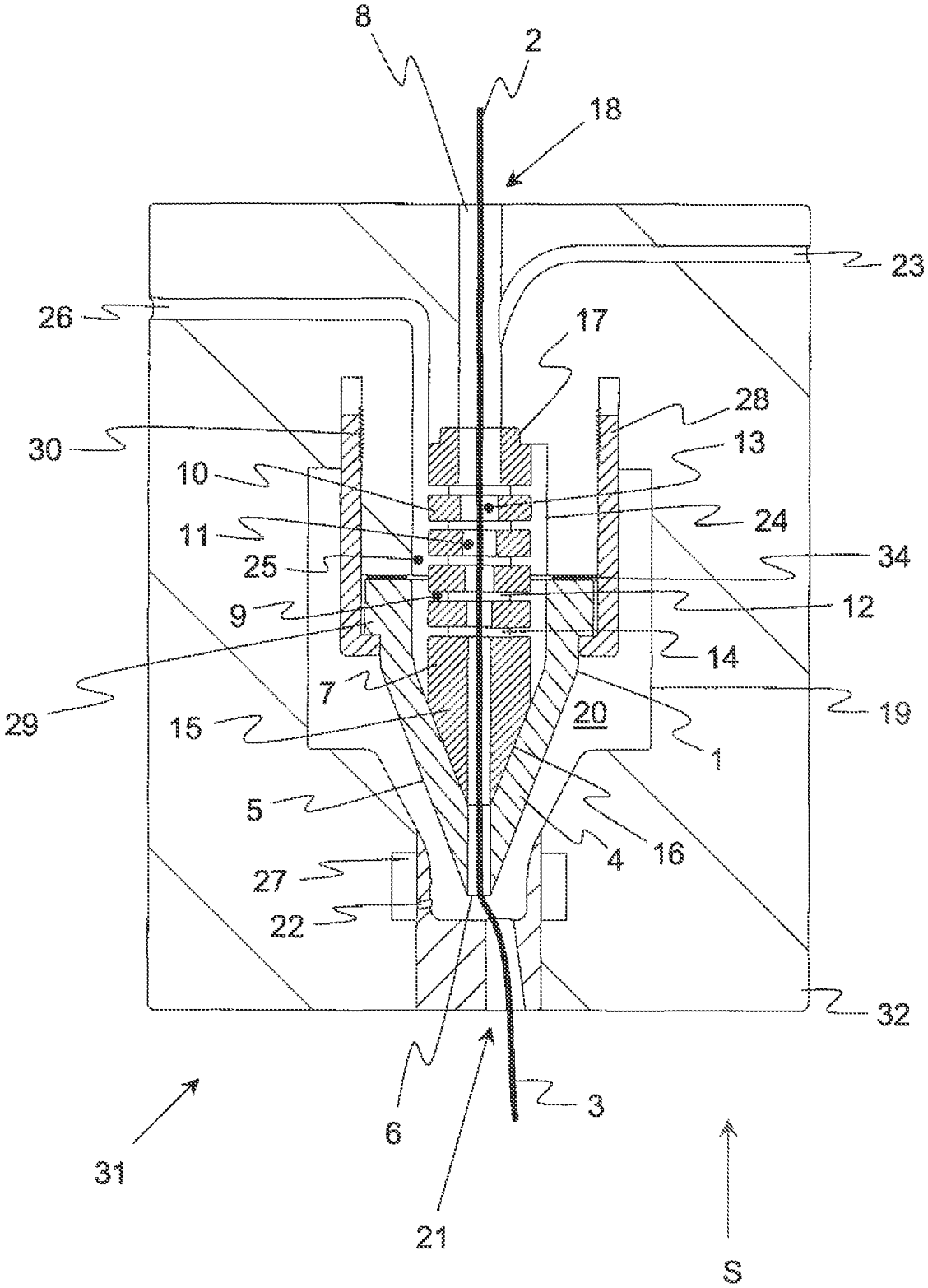
FIG. 1 is a sectional view of a spinneret under the invention.
Figure 2:
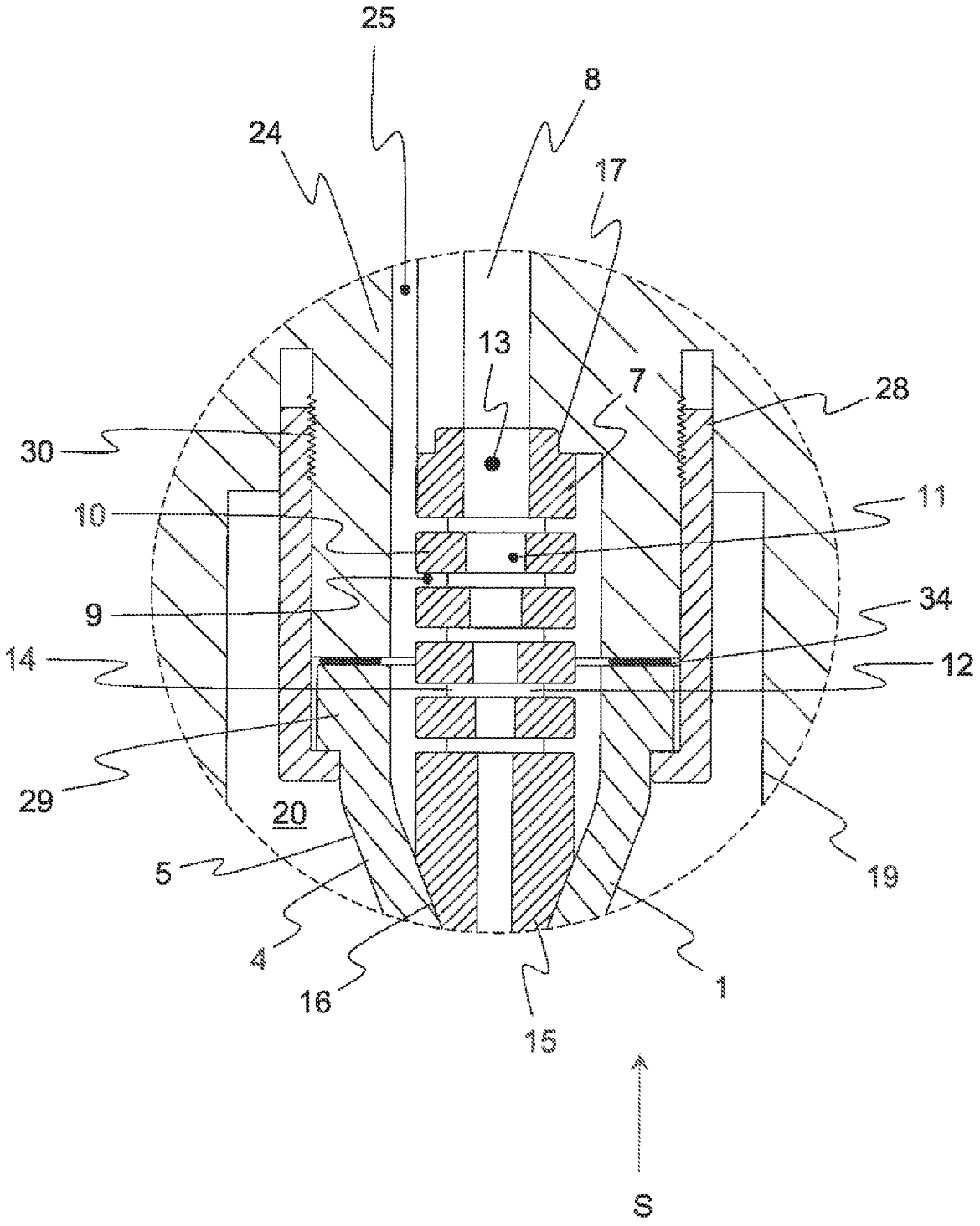
FIG. 2 is a section of the spinneret in accordance with FIG. 1.
Figure 3:
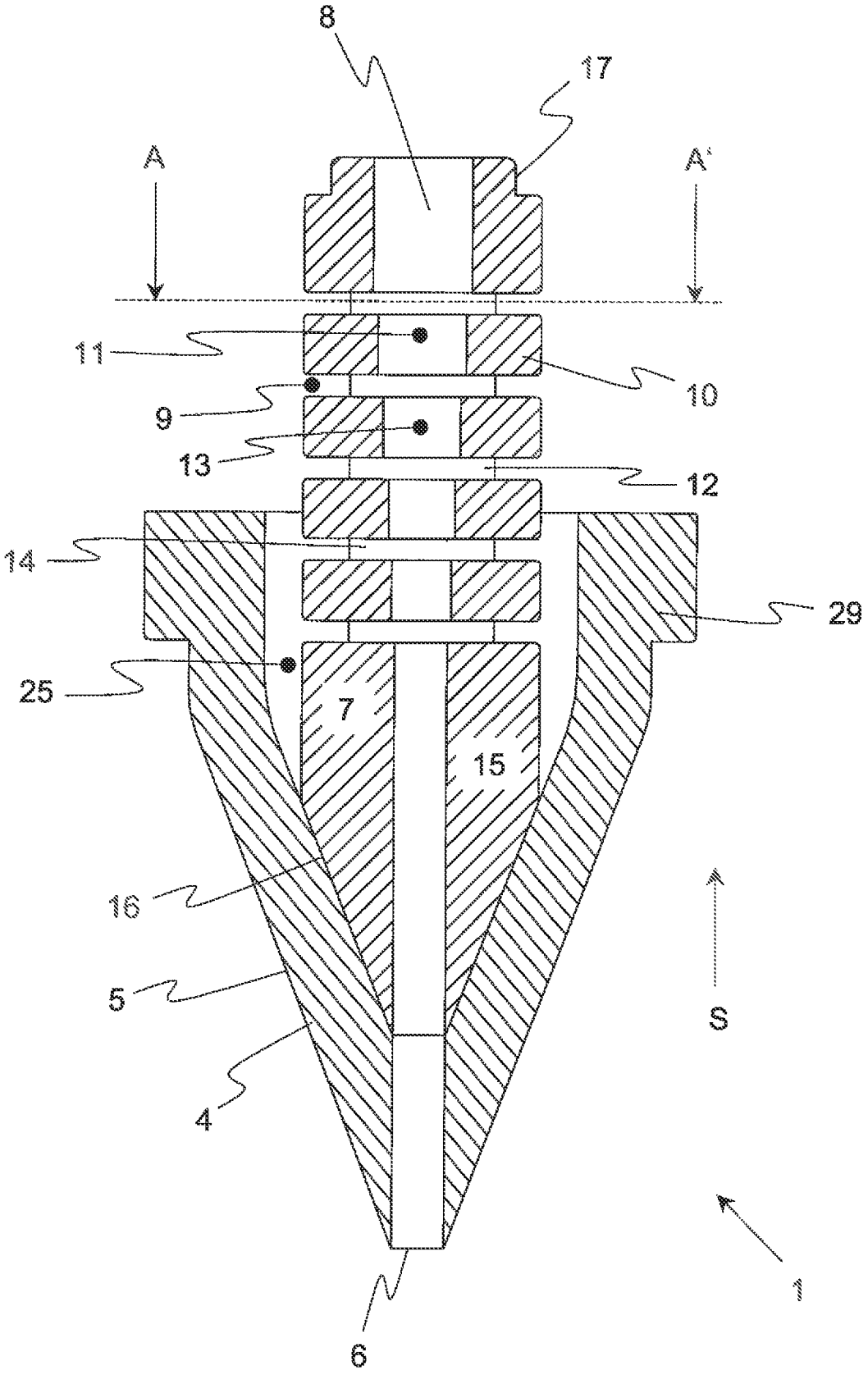
FIG. 3 is a sectional view of the yarn-producing apparatus under the invention shown in FIGS. 1 and 2, sectioned according to line C-C' in FIG. 4.
Figure 4:
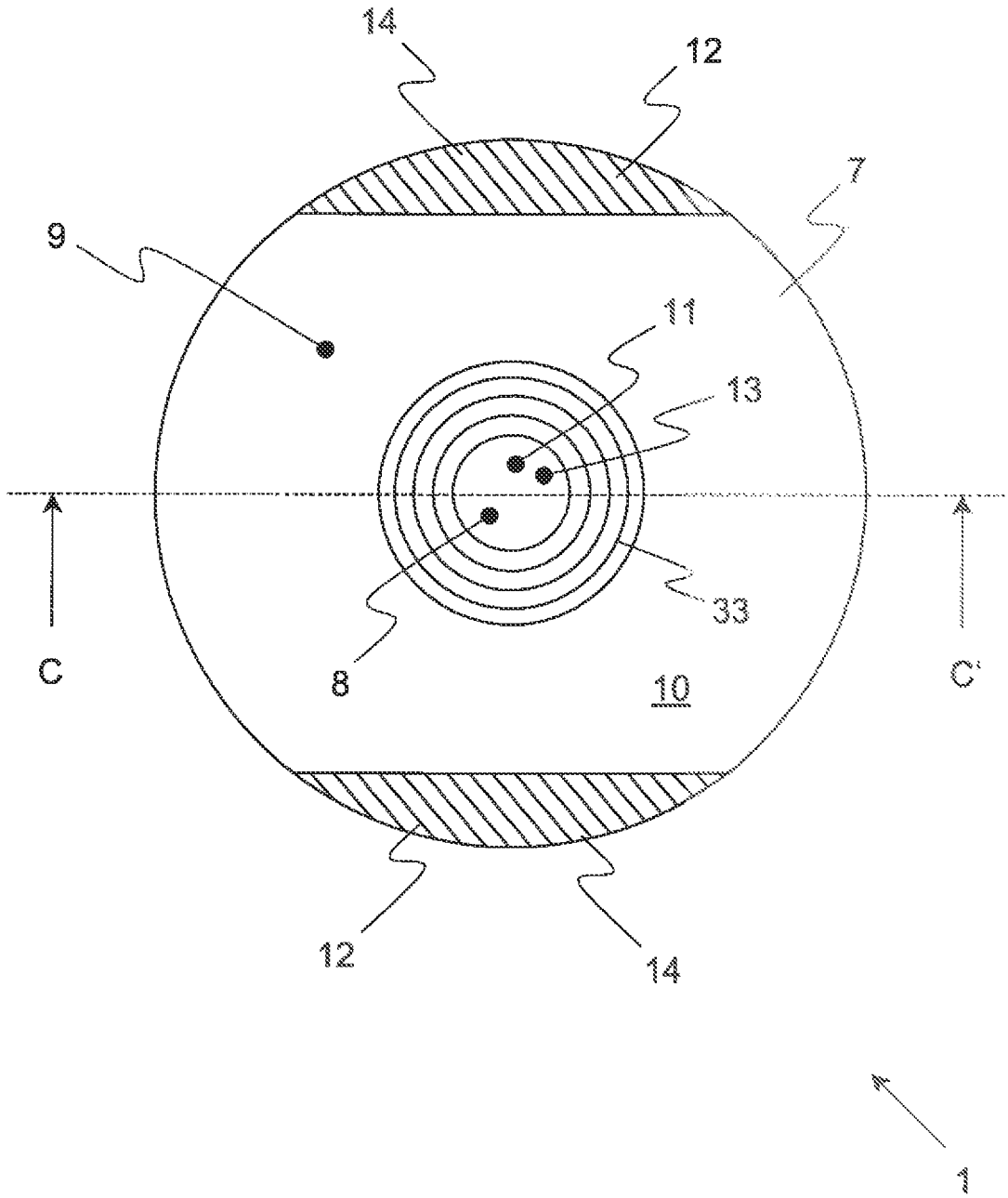
FIG. 4 is a sectional view of the yarn-producing apparatus from FIG. 3, sectioned according to line A-A' in FIG. 3.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

It should be stated in advance that, in the figures, which show several similar presented components (for example, the panels 10 shown in FIGS. 1 to 4), only one of several similar components is usually provided with reference signs, in order to ensure better clarity.

FIG. 1 shows a spinneret 31 under the invention of an air spinning machine (which typically includes a variety of corresponding spinnerets 31). The spinneret 31 has a housing 32 with an inflow outlet 21, through which a fiber strand 3 (which is supplied, for example, by a drafting system in front of a spinneret 31) is forwarded into a swirl chamber 20 on the inside and surrounded by a swirl chamber wall 19.

In turn, several air nozzles 22 lead into the swirl chamber 20 and are able to be provided with compressed air through a circular conduit 27 connected with a source of air pressure in a manner that is not shown. With the assistance of the air flow coming into the swirl chamber 20, preferably tangentially, the production of yarn known to the specialist ultimately takes place, with which the external fibers of the entering fiber strand 3 within the area of the spinning tip 4 and/or an outer surface 5 of a yarn-producing apparatus 1 are captured by the air, to a certain extent pulled out from the fiber strand 3 and ultimately wrapped around the remaining fiber strand core. The yarn 2 that is produced ultimately passes through the inlet opening 6 of the yarn-producing apparatus 1, and is ultimately extracted from the spinneret 31 through a draw-off conduit 8 following the inlet opening 6 (the extraction typically takes place with the assistance of an extraction device following the spinneret 31 in the spinning direction S, for example a pair of extraction rollers).

If an unintentional or intentional interruption of the spinning operation now arises, i.e. the producing of the yarn 2, the end of the yarn 2, which has already been produced, must be transported counter to the spinning direction S through the draw-off conduit 8, the swirl chamber 20 and the inflow outlet 21 of the spinneret 31, in order to be able to connect in the area in front of the spinneret 31 and be supplied again to the spinneret 31 (the so-called piecing process).

For this purpose, the spinneret 31 exhibits one (or several) injection nozzle(s) 23 leading into the draw-off conduit 8, which are or will be in connection with a source of excess pressure that is not shown. If the end of the yarn is now to be fed back through the spinneret 31 in the described manner, the injection nozzle 23 is supplied with excess pressure, such that an air flow arises, which air flow extends into the draw-off conduit 8 counter to the spinning direction S. In addition to an air flow counter to the spinning direction S, which is still to be more specifically described, this also gives rise to a negative pressure in the outlet area 18 of the spinneret 31, which causes the aspiration or suction of the end of the yarn.

As described in FIG. 1, the inlet opening 6 of the spinning tip 4 typically has a diameter that is smaller than the draw-off conduit 8 in the area of the injection nozzle 23. In other words, the inlet opening 6 thus represents a bottleneck, which would restrict the volume flow of air introduced with a certain air pressure at a certain value, which could turn out too low for the return of the yarn 2 in the area of the swirl chamber 20.

In order to address this problem, the yarn-producing apparatus 1 under the invention now features several air outlets 9, which branch off on the side of draw off conduit 8, whereas the air outlets 9 are arranged in the area of an inset 7 of the yarn-producing apparatus 1. This may be in contact, for example, through a front-area change in cross-section 17 with a counter-section of the spinneret 31, in order to create a transition between the inset 7 and the following section of the draw-off conduit 8.

As a review of FIGS. 1 to 4 shows, the air outlets 9 are preferably realized through individual panels 10, which are kept at a distance through the spacers 12 (which can be present, for example, in the form of the shown crosspieces 14) placed on the side of the draw-off conduit 8. The panels 10 are preferably formed in a circular manner and feature center openings 11, formed for example as holes 13, each of which in turn forms and/or limits a section of the draw-off conduit 8. Through the spacers 12, free spaces are ultimately created between the individual panels 10, through which a part of the air introduced through the injection nozzle 23 can escape.

For this purpose, it is advantageous if the diameters of the openings 11 of panels 10 are reduced counter to the spinning direction S. This gives rise to (ring shaped) gradations, which can be recognized particularly well in FIG. 4, on which the air coming from above impinges upon passing through the draw-off conduit 8. In turn, the gradations 33 cause the outer part of the air flow to be deflected and leave the inset 7 through the air outlets 9, which, in the case of FIGS. 1 to 4, are formed by the open spaces between the panels 10. Thereby, the inner partial air flow that is not deflected retains its initial speed, since a backing up of the introduced air is avoided, despite the reducing diameter of the draw-off conduit 8 counter to the spinning direction S. The result is a central (first) partial air flow, which extends from the originating point of the injection nozzle 23 through the draw-off conduit 8 and the inlet opening 6, into the swirl chamber 20, and from there through the inflow outlet 21 into the area in front of the spinneret 31, the speed of which, in the best case, remains (nearly) constant through the entire length, such that a reliable return of an end of the yarn counter to the spinning direction S is ensured.

In order to now prevent the (second) partial air flow segregated through the air outlets 9 from likewise arriving in the swirl chamber 20 and the return of the yarn end having an adverse effect there, the inset 7 under the invention is placed inside the spinning tip 4 of the yarn-producing apparatus 1 and is set with this, for example in the area of a tip 15 of the inset 7, against an inner surface section 16 of the spinning tip 4. For this purpose, the inset 7 can be formed, for example, as a (preferably one-piece) die-cast part, and/or can be glued or pressed with the spinning tip 4.

The spinning tip 4 is in turn fixed against a wall 24 of the spinneret 31 in such a manner that a chamber 25 closed to the swirl chamber 20 arises, which is in turn connected with one or more air extraction conduits 26 (see FIG. 1). For example, it would thereby be conceivable that the spinning tip 4, possibly under the interposition of a sealing element 34, is pressed against the specified wall 24 with the assistance of a cap sleeve 28, whereas the cap sleeve 28 may engage the spinning tip 4 to a retaining section 29, and may fasten to the wall 24 with the assistance of a thread 30.

As a result, the air flow segregated with the assistance of the air outlet 9 escapes solely through the air extraction conduit (s) 26, such that any influence of the partial air flow entering through the inlet opening 6 in the swirl chamber 20 can be effectively prevented.

Figure 5:
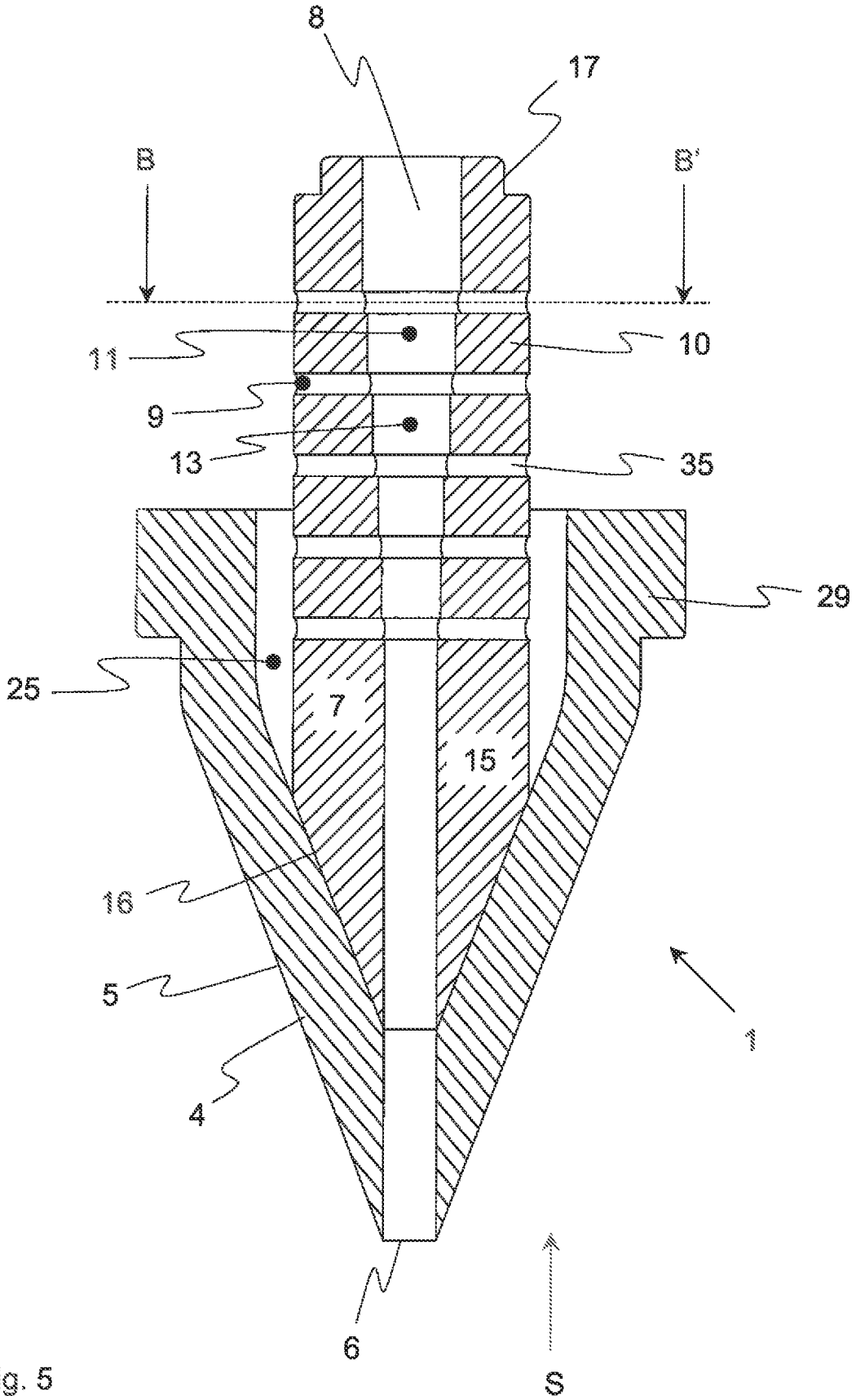
FIG. 5 is a sectional view of an additional yarn-producing apparatus under the invention, sectioned according to line of D-D' in FIG. 6.
Figure 6:
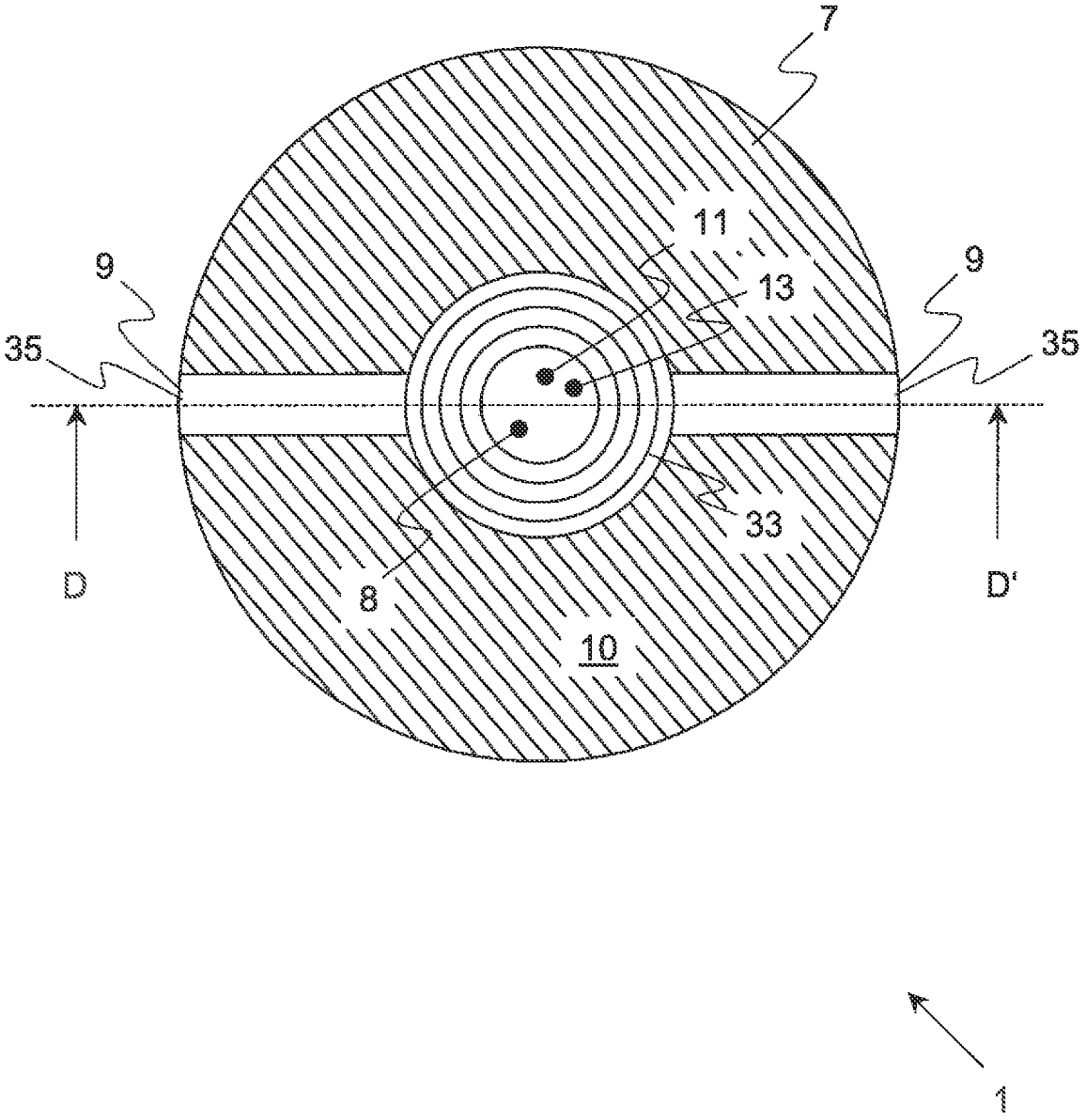
FIG. 6 is a sectional view of the yarn-producing apparatus from FIG. 5, sectioned according to line B-B' in FIG. 5.

Finally, a review of FIGS. 5 and 6 shows that the design of the inset 7 shown in FIGS. 1 to 4 is only understood as one example. Of course, the air outlets 9 may also be realized in ways other than that of the described panels 10, kept at a distance with the assistance of the spacers 12. For example, providing the inset 7 with air outlet holes 35, which likewise bring about the desired air segregation within the inset 7, is conceivable. The yarn-producing apparatus 1 shown in FIGS. 5 and 6 may, comparably to FIG. 1, ultimately be installed in an air spinning machine, in order to realize a spinning unit under the invention.

This invention is not limited to the presented and described embodiment. Variations in the scope of the patent claims are likewise possible as a combination of features, even if they are presented and described in different embodiments.

The invention claimed is:

1. An apparatus for producing yarn for use in an air spinning machine that produces a yarn from a fiber strand with assistance of an air flow, the apparatus comprising:

a spinning tip comprising an inlet opening surrounded by an outer surface of the spinning tip, wherein a yarn is formed at the inlet opening with assistance of the air flow;

an internal inset comprising a draw-off conduit adjacent to the inlet opening;

the internal inset further comprising a plurality of air outlets branching off from a side of the draw-off conduit; and wherein an air flow introduced counter to a spinning direction in the draw-off conduit during a piecing process escapes in part through the air outlets and in part through the inlet opening.

2. The apparatus as in claim 1, wherein the inset further comprises a plurality of adjacent panels spaced apart with a spacer between adjacent panels, the air outlets defined by open spaces between adjacent panels, each panel having an opening in a middle area thereof such that the plurality of openings in the panels are concentric, and the diameters of at least a majority of the panels being reduced in a direction towards the spinning tip as compared to panels further from the spinning tip.

3. The apparatus as in claim 2, wherein the open spaces between the panels have a range of between 0.2 mm and 2.0 mm, and the panels have a height dimension along the spinning direction of between 0.3 mm and 3.0 mm.

4. The apparatus as in claim 2, wherein the spacers are formed as crosspieces connecting adjacent panels, and the crosspieces are disposed at an edge area of the panels outward of the openings in the panels.

5. The apparatus as in claim 1, wherein the internal inset comprises a tip facing the inlet opening and disposed against an inner surface of the spinning tip, the internal inset further comprising a change in cross section at an opposite end thereof for connecting to an interior surface at an outlet area of a spinneret of the air spinning machine.

6. The apparatus as in claim 5, wherein the inset is formed as a one piece die-cast component having a wear resistant surface coating applied thereto.

7. A spinneret for use in an air spinning machine that produces a yarn from a fiber strand with assistance of an air flow, the spinneret comprising:

a swirl chamber surrounded in part by a swirl chamber wall;

an inlet defined through the swirl chamber wall for introducing a fiber strand into the swirl chamber;

a yarn producing apparatus extending into the swirl chamber;

air nozzles directed into the swirl chamber and aligned in a direction of an outer surface of the yarn producing apparatus, wherein air is introduced through the air nozzles into the swirl chamber to impart a twist in the fiber strand in an area of an inlet opening to the yarn producing apparatus;

the yarn producing apparatus further comprising:

a spinning tip comprising the inlet opening surrounded by an outer surface of the spinning tip;

an internal inset comprising a draw-off conduit adjacent to the inlet opening through which the yarn is extracted from the swirl chamber in a spinning direction;

the internal inset further comprising a plurality of air outlets branching off from a side of the draw-off conduit; and wherein an air flow introduced counter to a spinning direction in the draw off conduit during a piecing process escapes in part through the air outlets and in part through the inlet opening; and an injection nozzle in communication with the draw-off conduit through with the air flow is introduced counter to the spinning direction.

8. The spinneret as in claim 7, wherein the spinning tip of the yarn producing apparatus merges into a sleeve-shaped wall that surrounds the internal inset and defines an inner chamber around the internal inset, and further comprising an air extraction conduit in communication with the inner chamber, wherein the air flow introduced through the injection nozzle is segregated into a first partial flow that is guided into the swirl chamber from the inlet opening of the spinning tip, and a second partial flow guided into the inner chamber through the air outlets of the internal inset and then through the air extraction conduit without entering the swirl chamber.

9. The spinneret as in claim 7, wherein the spinning tip comprises a ring-shaped retaining section at an opposite end thereof from the inlet opening that is engaged by a cap sleeve for locking the spinning tip against an interior surface of the spinneret.

10. An internal inset for a yarn producing apparatus used in an air spinning machine that produces a yarn from a fiber strand with assistance of an air flow, the yarn producing apparatus comprising a spinning tip with an inlet opening surrounded by an outer surface of the spinning tip, wherein a yarn is formed at the inlet opening with assistance of the air flow, the internal inset further comprising:

a draw-off conduit adjacent to the inlet opening through which the yarn is extracted from the swirl chamber in a spinning direction; and a plurality of air outlets branching off from a side of the draw-off conduit; and wherein an air flow introduced counter to a spinning direction in the draw-off conduit during a piecing process escapes in part through the air outlets and in part through the inlet opening.

11. The internal inset as in claim 10, further comprising a plurality of adjacent panels spaced apart with a spacer between adjacent panels, the air outlets defined by open spaces between adjacent panels, each panel having an opening in a middle area thereof such that the plurality of openings in the panels are concentric, and the diameters of at least a majority of the panels being reduced in a direction towards the spinning tip as compared to panels further from the spinning tip.

12. The internal inset as in claim 11, wherein the open spaces between the panels have a range of between 0.2 mm and 2.0 mm, and the panels have a height dimension along the spinning direction of between 0.3 mm and 3.0 mm.

13. The internal inset as in claim 11, wherein the spacers are formed as crosspieces connecting adjacent panels, and the crosspieces are disposed at an edge area of the panels outward of the openings in the panels.

14. The internal inset as in claim 10, wherein the internal inset comprises a tip facing the inlet opening and disposed against an inner surface of the spinning tip, the internal inset further comprising a change in cross section at an opposite end thereof for connecting to an interior surface at an outlet area of a spinneret of the air spinning machine.

15. The internal inset as in claim 14, wherein the inset is formed as a one piece die-cast component having a wear resistant surface coating applied thereto.

* * * * *